United States Patent [19]

Hudson et al.

[11] Patent Number: 4,755,280

[45] **Date of Patent: * Jul. 5, 1988**

[54] PROCESS FOR IMPROVING THE COLOR AND OXIDATION STABILITY OF HYDROCARBON STREAMS CONTAINING MULTI-RING AROMATIC AND HYDROAROMATIC HYDROCARBONS

[75] Inventors: Carl W. Hudson; Glen P. Hamner, both of Baton Rouge, La.

[73] Assignee: Exxon Research and Engineering Company, Florham Park, N.J.

[ * ] Notice: The portion of the term of this patent subsequent to Dec. 6, 2003 has been disclaimed.

[21] Appl. No.: 760,962

[22] Filed: Jul. 31, 1985

[51] Int. Cl.[4] ..... C10G 65/12; C10G 45/00

[52] U.S. Cl. ..... 208/89; 208/49; 208/57; 208/58; 208/97; 208/210; 208/211; 208/212; 208/213

[58] Field of Search ..... 208/89, 97, 49, 57–60, 208/210–213

[56] References Cited

U.S. PATENT DOCUMENTS

| | | | |
|---|---|---|---|
| 3,272,734 | 9/1966 | MacLaren | 208/89 |
| 3,718,734 | 2/1973 | Christensen et al. | 208/212 |
| 3,899,543 | 8/1975 | Cosyns et al. | 208/89 |
| 4,066,530 | 1/1978 | Aldridge et al. | 208/207 |
| 4,067,799 | 1/1978 | Bearden et al. | 208/215 |
| 4,420,332 | 12/1983 | Mori et al. | 208/112 |
| 4,421,635 | 12/1983 | Murakami et al. | 208/112 |
| 4,451,354 | 5/1984 | Stuntz | 208/89 |

*Primary Examiner*—Helen M. S. Sneed
*Assistant Examiner*—Chung K. Pak
*Attorney, Agent, or Firm*—Roy J. Ott

[57] ABSTRACT

A process for improving the color and oxidation stability of feed characterized as an admixture of liquid hydrocarbon compounds, inclusive of fused multi-ring aromatic and hydroaromatic hydrocarbons. This feed, which boils within a range of from about 224° C. to about 538° C. and contains moderate to high concentrations of organic sulfur and organic nitrogen compounds, is (1) hydrotreated over a hydrotreating catalyst at hydrotreating conditions, or (2) hydrotreated over a hydrotreating catalyst at hydrotreating conditions and the high boiling product therefrom hydrocracked over a hydrocracking catalyst at hydrocracking conditions, to obtain a low sulfur, low nitrogen product which is contacted as a feed in the presence of hydrogen, over a catalyst comprised of elemental iron and one or more alkali or alkaline-earth metals components at hydrogen partial pressure and temperature sufficient to improve product color, or stablize the product against light and oxygen degradation, or both.

22 Claims, 2 Drawing Sheets

PROCESS FOR IMPROVING THE COLOR AND OXIDATION STABILITY OF HYDROCARBON STREAMS CONTAINING MULTI-RING AROMATIC AND HYDROAROMATIC HYDROCARBONS

RELATED APPLICATIONS

This application is related to application Ser. No. 611,859, filed May 18, 1984, titled "Process for the Denitrogenation of Nitrogen-Containing Hydrocarbon Compounds" by Carl W. Hudson, now abandoned, and to application Ser. No. 635,729, filed July 30, 1984, titled "Process for the Removal of Polynuclear Aromatic Hydrocarbon Compounds From Admixtures of Liquid Hydrocarbon Compounds" by Carl W. Hudson and Glen P. Hamner, now abandoned.

Other related applications are: application Ser. No. 760,871 by Carl W. Hudson; application Ser. No. 760,961 by Carl W. Hudson and Glen P. Hamner; application Ser. No. 760,834, by Carl W. Hudson and Gerald E. Markley; application Ser. No. 760,894, by Carl W. Hudson and Glen P. Hamner; and application Ser. No. 760,835, by Carl W. Hudson and Glen P. Hamner; filed of even date herewith.

BACKGROUND OF THE INVENTION

I. Field of the Invention

This invention relates to a process for improving the color and oxidation stability of feedstreams which contain multi-ring aromatic and hydroaromatic compounds. In particular, it relates to a process for improving the color and oxidative stability of hydrocarbon feedstreams which contain multi-ring aromatics and their partially or fully hydrogenated derivatives, especially hydrocracked feedstocks of such character useful as lubes basestocks.

II. Background and Prior Art

In hydrogenation reactions, especially those conducted at high severities, or at temperatures and pressures less than optimum for some period of a total operating cycle, there is often a decline in product quality manifested by higher color, or propensity of the product to become discolored, or further discolored, on exposure to light or oxygen, or both. Hydrogenation, or hydroconversion reactions, e.g., hydrocracking reactions, thus produces liquid products which are unstable in the presence of light and oxygen (air). This instability manifests itself in the form of color degradation to produce darker liquids, or solid sediments, or both; the sedimentation usually appearing as a dispersed phase which clouds and discolors the liquid products as dark colored precipitates. Degradation of products in this manner occurs sometimes immediately, and ofttimes after the products have been stored for some period; often very short periods. Such degradation often causes performance problems in the ultimate end products; or, may simply limit customer acceptance of the products. Color and oxidative stability is especially important in the production of lubes, for which reason lubestocks and finished products produced therefrom must meet a number of rigid stability tests to assure both product performances and customer acceptance. For example, hydrocracked feedstocks, such as recycle streams obtained from high pressure hydrocrackers, must meet these rigid stability tests. Such feedstocks can be considered useful lubes basestocks, if they can meet "daylight stability" test requirements, an accelerated aging test werein the sample is exposed to air and light at elevated temperature.

The daylight stability test indicates the propensity for a lubestock to darken in color, or throw a sediment, or both, when exposed to light and oxygen under specific conditions. It is believed that this type of instability is caused by the presence of multi-ring aromatics, generally fused multi-ring aromatics or their partially or fully hydrogenated derivatives.

Multi-ring aromatic compounds are characterized as aromatic or hydroaromatic compounds, or both, composed of two or more fused rings. Such compounds include naphthalene and its derivatives (2-rings), anthracene and its derivatives (linear 3-rings), phenanthrene and its derivatives (angular 3-rings), benzanthracenes and benzphenanthrenes (4-rings), indenes, fluorenes, pyrenes, acenaphthenes, and other hydrocarbon compounds of these general types. Hydroaromatics are compounds of these types in which one or more of the rings of the parent multi-ring aromatic compounds have been reduced, or partially reduced with hydrogen. Compounds of these classes which contain three or more fused rings are generally termed polynuclear aromatic hydrocarbons, or PNA's. These types of compounds appear particularly susceptible to color and oxidation reactions which are initiated in the presence of oxygen, particularly on exposure to light; especially, ultraviolet light. Since it is not practical, in many instances, to keep consumer products, e.g., lubes and motor fuels, free from air and light exposure, a simple means to improve oxidative stability would be very useful for improving the ultimate quality of many products derived from petroleum or synthetic petroleum sources, e.g., coal, shale, and tar sands. Thus, there is a profound need for a simple and economical process for improving the color and oxidative stability of streams rich in fused mutli-ring aromatic and hydroaromatic hydrocarbons, particularly lubes basestocks, or stocks useful for lubes and fuels applications.

III. Objects

It is, accordingly, the primary purpose of this invention to fill this need.

In particular, it is an object to provide a process whereby multi-ring aromatic and partialy or fully hydrogenated multi-ring aromatic hydrocarbons, including PNA's and hydro-PNA's, which cause color and oxidative instability in hydrocarbon mixtures can be converted to more stable aromatic molecules.

A further, and more specific object is to provide a process which improves the color and oxidative stability of hydrocarbon products which are normally too color and oxidatively instable to be used in product formulations, especially lubes basestocks formulations.

IV. The Invention

These objects and others are achieved in accordance with the present invention embodying a process wherein a feed comprising an admixture of liquid hydrocarbon compounds, inclusive of a fused multi-ring aromatic hydrocarbon or hydrogenated fused multi-ring aromatic hydrocarbon, or both, containing up to about 10 parts per million parts (ppm) organic sulfur, preferably from about 1 to about 5 parts per million parts, based on the total weight of the feed (wppm) and up to about 10 wppm organic nitrogen, preferably from about 1 to about 5 wppm, based on the weight of total feed, is contacted in the presence of hydrogen over a catalyst which contains elemental iron and one or more of an alkali or alkaline-earth metal [i.e., a Group IA or IIA metal (Periodic Table of the Elements, E. H. Sargent & Co., Copyright 1964 Dyna-Slide Co.)] or compound thereof, and preferably additionally a Group IIIA metal, or metal compound, particularly aluminum, or compound thereof, at temperature sufficient to produce a better color, more oxidatively stable product, as contrasted with said feed. A feed particularly susceptible to such treatment to provide a more color and oxidatively stable product is one containing up to about 5 wppm, organic sulfur, and up to about 5 wppm organic nitrogen, preferably up to about 1 wppm organic sulfur, and up to about 1 wppm organic nitrogen, which feed boils above about 430° F. (224° C.). Preferably, the feed boils within a range of from about 430° F. (224° C.) to about 1000° F. (538° C.), more preferably within a range of from about 650° F. (343° C.) to about 1000° F. (438° C.). Such feed is contacted over the iron catalyst at temperature ranging from about 225° C. (437° F.) to about 430° C. (806° F.), more preferably from about 250° C. (482° F.) to about 350° C., (662° F.) and at hydrogen partial pressures ranging from about 0 psig to about 1000 psig, preferably from about 100 psig to about 600 psig, sufficient to stabilize the product of said reaction against oxygen and light, or color degradation.

In accordance with this invention many hydrocarbon feedstocks which are normally too color and oxidatively instable to be used directly as products, or in product formulations, can be satisfactorily stabilized against oxygen and light to prevent or retard color degradation and/or sediment formation. These include, in particular, (i) jet fuels and diesel fuels, which in tankage are unstable and form sediment upon standing; (ii) hydrocarbon mixtures which fail to meet customer acceptance due to discoloration or sedimentation, or which possess a propensity to become discolored or to throw sediments, or both, on standing, e.g., solvents or lubricating oils; and especially (iii) hydrocracked stocks for lubes applications, which can be stabilized sufficiently to pass certain required stability requirements or specifications.

In particularly preferred operations, organic sulfur and organic nitrogen containing aromatic or hydroaromatic feeds can be hydrotreated to reduce the sulfur and nitrogen concentrations, respectively to very low levels, suitably below about 5 wppm, respectively, and preferably below about 1 wppm, respectively, and the relatively high boiling products therefrom, as feeds, can be treated, in the presence of hydrogen, over the iron catalyst to provide lubes basestocks which possess superior color and oxidative stability. Hydrocracked aromatic or hydroaromatic feeds can be similarly treated in the presence of hydrogen over the iron catalyst to produce lubes basestocks which possess superior color and oxidative stability.

The alkali or alkaline-earth metal promoted iron catalyst required for the practice of this invention can be supported or unsupported, but in either instance the catalytic surface is one which is constituted essentially of metallic, or elemental iron (Fe°) crystallites about which the alkali or alkaline-earth metals are dispersed, generally as a monolayer of an alkaline oxide or alkaline-earth metal oxide. The catalyst is unsulfided, and can function in the presence of sulfur only when a sufficient portion of the catalytic surface of the catalyst is substantially metallic, or elemental iron (Fe°). The formation of sufficiently high concentrations of sulfur at the catalyst surface tends to produce catalyst deactivation via the formation of iron sulfide upon the catalyst surface as a consequence of which the use of feeds which contain high concentrations of sulfur or sulfur compounds should be avoided. High concentration of feed sulfur will soon deactivate the catalyst by converting a major portion of the metallic, or elemental iron surface of the catalyst to iron sulfide.

Whereas applicants do not wish to be bound by any specific theory of mechanism, it is nonetheless believed that the stabilization of products treated in accordance with this invention can be explained. Thus, it is believed that the conventional hydrogenation of fused multi-ring aromatics produces hydrogenated intermediates wherein some of the carbon-carbon and carbon-hydrogen bonds of the parent compounds become more susceptible to reaction with oxygen, often promoted by the exposure to light, than the parent, fully aromatic compounds. Certain phenomena occur as a result of the association between these active sites and oxygen. First, aldehydes, acids, ketones, and the like are formed, these often being highly colored materials. Moreover, as a result of the oxygenation reactions there can be created new multiple order bonds between carbon atoms and carbon/oxygen atoms which increases the number of conjugated bonds in the molecule. The increased conjugation between the carbon atoms increases the formation of color; and where both oxygen and conjugated bonds are present in the same molecule there is a synergistic effect which further intensifies color formation. Furthermore, the oxygen atoms provide reaction sites, e.g., sites for hydroxyl, carbonyl, or carboxyl appendages to the molecule, which react with each other or with other compounds, this leading to the formation of larger molecules which appear as solids dispersed in a liquid phase, or as precipitates.

The process of this invention will be better understood by reference to the following specific, and preferred embodiments and to the drawings which are simplified flow diagrams depicting the various steps of a given process. Valves, pumps, compressors, separators, reboilers, and the like have been omitted from the drawing for clarity.

Figure 1:
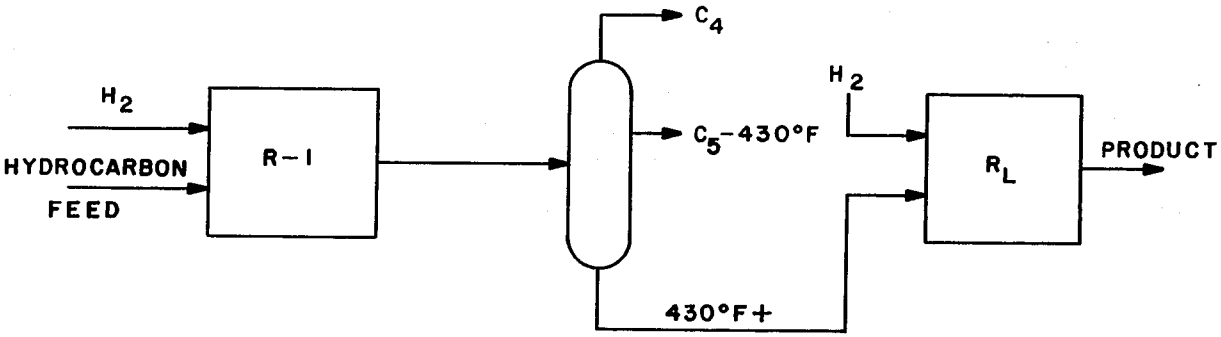
FIG. 1 depicts in part a generally conventional hydrotreating unit, the block diagram portion thereof representing at least one, and preferably a series of hydrotreating reactors, and distillation unit for separation of the hydrotreated products. The product post treatment unit which is employed to treat a low sulfur, low nitrogen product from the fractionation unit, taken in combination with the hydrotreating unit, and distillation unit, constitutes a novel and preferred process combination in accordance with this invention.

Referring first to FIG. 1, there is depicted a block diagram R-1 which is representative of one, and preferably a series of hydrotreating reactors, preferably from two to about four, each of which contains a hydrotreating catalyst over which a feed containing one or more multi-ring aromatic hydrocarbons and/or the fully or partially hydrogenated derivatives thereof is contacted, in the presence of hydrogen, primarily to remove heteroatoms from the feed molecules, or to hydrogen saturate the aromatics portions thereof. In conducting the hydrotreating operation, it is essential to reduce the sulfur and nitrogen concentration of the feed, which is best done by the use of interstage hydrogen sulfide and ammonia separators (not shown). Suitable catalysts for conducting such hydrotreating reaction comprise Group Vi-B and Group VIII metals, especially iron group metals of the Periodic Table of Elements, generally in their reduced form, or in the form of their oxides or sulfides, either unsupported or dispersed on a support, or carrier. Exemplary of such catalystic metals are nickel, cobalt, molybdenum, tungsten, and the like; including particularly admixtures of cobalt and molybdenum, and nickel and molybdenum which are especially suitable as hydrogenation components. As is customary in the art of catalysis, when referring to a catalytically active metal, or metals, the reference is intended to encompass the existance of such metal in the elementary state or in the form of an oxide, sulfide, halide, or the like. Regardless of the state in which the metallic component actually exists, the concentrations of the metals are computed and reference to the metal is made as though it existed in its elemental state. The catalysts are preferably constituted of composite particles which contain, besides a hydrogenation component, a support material constituted of a porous, refractory inorganic oxide, particularly alumina. The metal content of a catalyst generally ranges from about 2 to about 25 percent, based on the total weight of the catalyst. The support can contain, e.g., one or more of alumina, bentonite, clay, diatomaceous earth, zeolite, silica, activated carbon, magnesia, titania, zirconia, thoria, and the like; though the most preferred support is alumina to which, if desired, can be added a suitable amount of other refractory carrier materials such as silica, zirconia, magnesia, titania, or the like, usually in a range of about 1 to 20 percent, based on the weight of the support. Exemplary of commercially known high metals content catalysts employed by the industry are, e.g., HND-30, KF-840, NM-504, and RT-3.

The feed introduced into R-1 is typically high in organo sulfur and organo nitrogen content, i.e., generally ranging from about 0.2 percent to about 3 percent organo sulfur and from about 0.02 to about 0.4 percent organo nitrogen, respectfully, or more typically from about 1 to about 2 percent organo sulfur and from about 0.03 to about 0.2 percent organo nitrogen, respectfully, based on the weight of the feed. The organo sulfur and organo nitrogen compounds are typically distributed throughout the boiling range of the total feed. Suitable feeds are those derived from petroleum sources these including virgin gas oil, vacuum gas oil, coker gas oil, visbreaker gas oil, petroleum distillates, and the like; and including those derived from synthetic sources, e.g., hydrocarbon oils derived from coal liquefaction processes, coal liquefaction bottoms, and the like; as well as those derived from shale or tar sands. Such feeds can be relatively low in aromatics, or high in aromatics. They can contain, e.g., in excess of 60 volume percent aromatics, or up to about 85 volume percent aromatics, such as cycle oil obtained from cracking heavy petroleum fractions as gas oils, employing either a synthetic or natural zeolitic catalyst. Suitable feedstocks can boil generally within a range of from about 320° F. (160° C.) to about 1000° F. (538° C.), or from about 400° F. (204° C.) to about 900° F. (482° C.).

The hydrotreating reaction is conducted under conditions of temperature, pressure, hydrogen flow rate and liquid hourly space velocity, correlated to provide the desired degree of organic sulfur and organic nitrogen conversion. The hydrotreating temperature generally ranges from about 325° C. (617° F.) to about 450° C. (842° F.) and preferably from about 350° C. (662° F.) to about 425° C. (797° F.). Temperatures are not particularly critical. In general however, at temperatures below about 325° C. (617° F.), the rate of conversion of organic nitrogen and organic sulfur compounds is too low for practical use, whereas at temperatures above about 450° C. (842° F.) substantial cracking of the feed can occur. Also coke formation tends to increase markedly at the higher temperatures. The temperature used will also depend on the activity of the hydrotreating catalyst, higher temperatures being used with less active catalysts. The pressure in the hydrotreating zone will generally range from about 1000 psig to about 3000 psig, and more preferably ranges from about 1500 psig to about 2000 psig. Elevated pressures advantageously influence the rate and extent of hydrotreating, as well as extend the catalyst activity and life. However, higher pressures increase the cost of the hydrofining operation. The liquid hourly space velocity in the reactors will generally range from about 0.1 to about 5, preferably from about 0.2 to about 2.

The flow of hydrogen into the hydrotreating reactor, or reactors, is preferably maintained above about 1000 SCF/Bbl, suitably from about 1000 to about 10,000 SCF/B, and more preferably within a range of from about 2000 to about 6000 SCF/Bbl. More generally, at least sufficient hydrogen is provided to supply that consumed in the conversion of sulfur and nitrogen compounds to hydrogen sulfide and ammonia, respectively, and to the extent desired to produce the hydrogenation of unsaturated compounds, e.g., olefins, while generally maintaining a significant excess of hydrogen partial pressure. The hydrogen can be added to the feed prior to introduction of the feed into the hydrotreating reactor, or reactors, or can be added to the hydrotreating reactor, or reactors, separate from the feed. The hydrogen is passed through the hydrotreating reactor, or reactors, in contact with the catalyst on a once-through basis, or is recycled. The effluent from the hydrotreating unit is treated to remove hydrogen sulfide and ammonia from the hydrotreated product, and preferably hydrogen sulfide and ammonia are removed between each stage of hydrotreatment within the individual reactors of a unit.

The product of R-1 is passed into a flash drum (not shown) and separated into a sour gas stream containing ammonia, hydrogen sulfide, and $C_4$- hydrocarbon gases which is removed from the top of the drum, and a liquid bottoms fraction which is removed from the bottom of the drum. The liquid bottoms fraction is passed into a distillation column and therein separated into a naphtha and distillate fraction and a low sulfur, low nitrogen, higher boiling bottoms component. The relatively high boiling bottoms component boiling above about 430° F. (224° C.), and preferably within a range of from about 430° F. (224° C.) to about 1050° F. (574° C.), contains less than about 10 wppm sulfur, preferably less than about 5 wppm sulfur, and less than about 10 wppm nitrogen, preferably less than about 5 wppm nitrogen. The low sulfur, low nitrogen product is next treated over an iron catalyst in a second, or final reactor $R_L$ as described hereafter to form a high quality lubes basestock.

Figure 2:
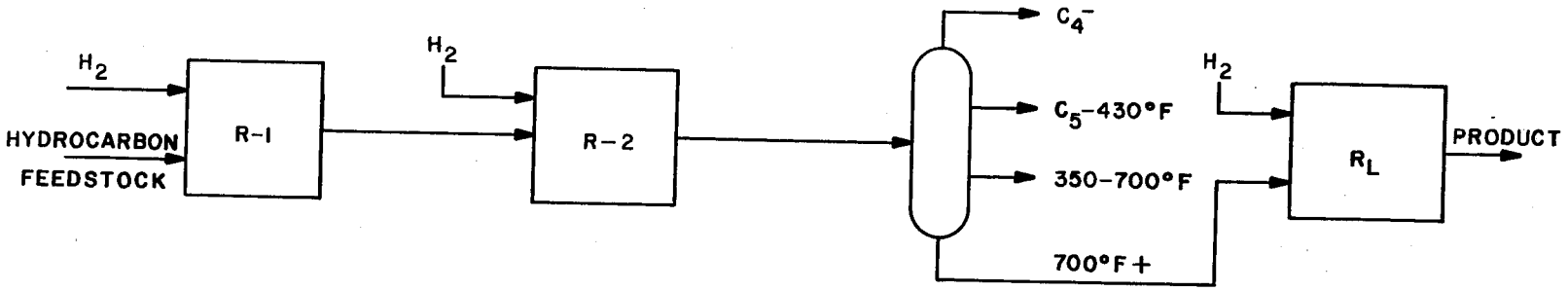
FIG. 2 depicts in part a generally conventional combination of a hydrotreating and hydroconversion unit, the first block diagram portion thereof representing one or a series of hydrotreating reactors, the second one or a series of hydrocracking reactors, and a distillation unit for separation of the product from said reactors. The product post treatment unit, or unit which is employed to treat a low sulfur, low nitrogen product from the fractionation unit, taken in combination with the hydrocracking unit and distillation unit, or the combination of both the hydrotreating and hydrocracking unit, inclusive of the distillation unit, constitutes novel and preferred process combinations in accordance with this invention.

Referring next to FIG. 2, the unit contains besides R-1, a hydrocracking unit R-2, R-1, the feed, the catalyst employed therein and the conditions of operation, of this reactor are as described by reference to FIG. 1. The product of R-1 is introduced into a flash drum (not shown) and the sulfur and nitrogen removed therefrom essentially as hydrogen sulfide and ammonia. The R-1 product removed from the flash drum and fed, with hydrogen, to R-2 contains no more than about 50 wppm sulfur and no more than about 10 wppm nitrogen, respectively. R-2 is depicted by a block diagram which is representative of one or a series of hydrocracking reactors, usually one to four in number, each of which contains a hydrocracking catalyst over which the liquid product of R-1 is introduced as a feed and reacted to convert the hydrotreated material to lower molecular weight, lower boiling hydrocarbons.

Various hydrocracking catalysts known to the art can be employed in R-2. Such catalysts are dual functional, providing both hydrogenation (hydrogen transfer) and cracking functions. Suitably such catalysts comprise one or more components selected from Group VI-B and VIII of the Perodic Table of the Elements, which provide the hydrogenation function. The catalyst comprises at least one metal, metal oxide, or metal salt of, e.g., chromium, molybdenum, tungsten, iron, cobalt, nickel, ruthenium, rhodium, palladium, osmium, iridium, and platinum dispersed on a support. As is customary in the art of catalysis, when referring to a catalytically active metal, or metals, the reference is intended to encompass the existance of such metal in the elementary state or in the form of an oxide, sulfide, halide, or the like. Regardless of the state in which the metallic component actually exists, the concentrations are computed and reference to the metal is made as though it existed in its elemental state; regardless of the state in which the metal actually exists. The support for the metallic component for hydrocracking catalyst is usually, and preferably a porous, inorganic oxide and a component of an acidic nature which provide the cracking function, e.g., halogen such as hydrogen chloride, hydrogen fluoride or the like. Generally, it is advantageous to add the halogen to the catalyst prior to use, generally in concentration ranging from about 0.1 to about 5 percent preferably from about 0.9 to about 3 percent, based on the weight of the catalyst. Such supports can be alumina, silica, silica-alumina, crystalline aluminosilicate zeolites, and the like. Of the acid components the crystalline aluminosilicate zeolites are the most active in the sense that they generally convert the highest fraction of the feed to products under relatively milder operating conditions. In general, the hydrogenation component is employed in concentrations ranging from about 0.1 to about 25 percent, preferably from about 0.3 to about 15 percent, based on the weight of the catalyst. Specific examples of preferred catalysts are, e.g., nickel-tungsten-silica-alumina, nickel-molybdenum-silica-alumina, cobalt-molybdenum-silica-alumina, fluorided nickel-tungsten, fluorided nickel-molybdenum, fluorided palladium-alumina, palladium-silica-alumina, or a crystalline aluminosilicate support composited with any of nickel-tungsten, cobalt-molybdenum, nickel-tungsten or the like. Representative crystalline aluminosilicate zeolites include, e.g., zeolite X, zeolite Y, and synthetic mordenite as well as naturally occurring zeolites, including chabazite, faujasite, mordenite and the like.

The hydrocracking reaction is conducted over the hydrocracking catalysts under conditions of temperature, pressure, hydrogen flow rate and liquid hourly space velocity, correlated to remove $C_4$-gases and optimize conversion of the feed into gasoline, distillate fuels, and a heavy product suitable for lube stock. The temperature at which the hydrocracking reactor, or reactors, is operated generally ranges from about 250° C. (482° F.) to about 450° C., (842° F.), and preferably from about 275° C. (527° F.) to about 400° C. (752° F.). Temperatures are not particularly critical, but at temperatures below about 250° C. (482° F.), the rate of conversion of most hydrocarbon molecules is generally slower than necessary, and at temperatures above about 450° C. coke formation on the catalyst and light gas formation in the product tends to increase markedly. The temperature used will also depend on the activity of the hydrocracking catalyst, higher temperatures being used with less active catalysts. The pressure in the hydrocracking reactor, or reactors, will generally range from about 1000 psig to about 10,000 psig, and more preferably ranges from about 1500 psig to about 2000 psig. Elevated pressures advantageously influence the rate and extent of hydrocracking, as well as extend the catalyst activity and life. However, higher pressures increase the cost of the hydrocracking operation. The liquid hourly space velocity in the reaction zone will generally range from about 0.1 to about 5, preferably from about 0.5 to about 2.

The flow of hydrogen into the hydrocracking reactor, or reactors, is preferably maintained above about 1000 SCF/Bbl generally from about 1000 to about 10,000 SCF/B, and more preferably within a range of from about 2000 to about 6000 SCF/Bbl. The hydrogen can be added to the feed prior to introduction of the feed into the hydrocracking reactor, or reactors, or can be added to the hydrocracking reactor, or reactors, separate from the feed. The hydrogen is passed through the reactor, or reactors, n contact with the catalyst on a once-through basis, or is recycled. Hydrogen sulfide and ammonia must be removed from the product prior to introduction of the effluent into the final reactor of the series, and suitably this is accomplished by introduction of the product of R-2 into a flash drum (not shown) which removes most of the sulfur and nitrogen. The liquid bottoms from the flash drum is then passed into the distillation column. The product of R-2 fed into the distillation column is separated into fractions which include a sour gas containing ammonia and hydrogen sulfide, naphtha and distillate fractions and a low sulfur, low nitrogen high boiling residue which is removed from the bottom of the fractionation column and fed into the final reactor of the series. This product contains less than 10 wppm sulfur, preferably less than 5 wppm sulfur, and less than 10 wppm nitrogen, preferably less than about 5 wppm nitrogen.

In both R-1 and R-2 but especially under the conditions of R-2, unstable compounds are formed which are converted to highly colored products, or products having a high propensity to form color on exposure to light and oxygen, or both.

The low sulfur, low nitrogen heavy bottoms fraction from the distillate column used to separate into fractions the R-1 product (FIG. 1) and the R-2 product in both R-1 and R-2 (FIG. 2) are similarly treated in a final reactor $R_L$ by passage over a catalyst which contains elemental iron and one or more of an alkali or alkaline-earth metal, or compound thereof, and preferably additionally a Group IIIA metal, or metal compound, particularly aluminum, or compound thereof in the presence of hydrogen, to stabilize said products and thereby suppress color and oxygen degradation. Thus, as shown by reference to FIGS. 1 and 2, respectively, the low sulfur, low nitrogen-containing heavy bottoms fraction distilled from product R-1, or both R-1 and R-2, respectively, is contacted with hydrogen, or hydrogen-containing gas, over the iron catalyst at reaction conditions sufficient to reduce the color, and propensity of the product to form color or sediment, or both, on standing in the presence of oxygen and light. Suitably, the reaction in $R_L$ is conducted at temperatures ranging from about 225° C. (437° F.) to about 430° C. (806° F.), preferably from about 250° C. (482° F.) to about 350° C. (662° F.), and under an atmosphere of hydrogen gas or admixure of hydrogen and another gas, or gases within which the hydrogen partial pressure ranges from about 0 psig to about 1000 psig, preferably from about 100 psig to about 600 psig. Some positive pressure of hydrogen is necessary in conducting the reaction, though the hydrogen pressure can thus be at atmospheric pressure, or less. The combination of temperature and hydrogen partial pressure are preferably such that a part of the feed, at reaction conditions, is in vapor phase. Temperatures above about 430° C. (806° F.) generally should not be employed because excessive temperature causes cracking of the feed, and carbon fouling of the catalyst. At temperatures below about 225° C. (437° F.), on the other hand, the temperature is generally inadequate to reduce color, or the propensity of the product to become discolored on standing. Total pressures are not critical, but generally range from about 0 psig to about 1200 psig, preferably from about 100 psig to about 750 psig. Treat gas rates, based on hydrogen, range from about 500 to about 10,000 SCF/B, preferably from about 1000 to about 5000 SCF/B. Space velocities range generally from about 0.05 LHSV to about 20 LHSV, preferably from about 0.2 LHSV to about 10 LHSV.

Elemental iron, modified with one or more alkali or alkaline-earth metals, or compounds thereof, is present in the catalyst sufficient to reduce on contact with the R-1 or R-2 product, as a feed, at reaction conditions the color of the feed, and propensity of the product to become discolored on standing. The catalyst employed in the final reactor of the series, $R_L$, may be bulk (unsupported) iron, or iron dispersed upon a support. The bulk iron catalyst is preferred and it may be employed as essentially metallic iron in bulk promoted or modified with alkali or alkline-earth metals, or metal oxides such as sodium, potassium, cesium, magnesium, calcium, barium, or the like. The active iron catalyst, when a bulk iron catalyst, is preferably one which contains at least 50 percent elemental iron, more preferably from about 70 percent to about 98 percent elemental iron, based on the weight of the catalyst. The iron catalyst, when a catalyst wherein the iron is distributed or dispersed upon a support, contains at least about 0.1 percent iron (measured as elemental iron), preferably from about 0.1 percent to about 50 percent iron, and more preferably from about 5 percent to about 25 percent iron, based on the total weight of the catalyst, and the supported metallic component, exclusive of the support component, or components, contains at least 50 percent iron (measured as elemental iron), and preferably from about 70 percent to about 98 percent iron.

A bulk fused iron catalyst is preferred for use in $R_L$. The fused iron is one fused by heating and melting the iron, thus fusing the iron with an alkali or alkaline-earth metal, or metals, or with an alkali or alkaline-earth metal compound, or compounds, which are generally present in concentrations ranging from about 0.01 percent to about 10 percent, preferably from about 0.2 percent to about 4 percent, based on the total weight of catalyst. Sodium, potassium, cesium, magnesium, calcium, and barium are the preferred alkali or alkaline-earth metals. Aluminum is also a preferred component of the fused iron-alkali or alkaline-earth metal catalyst, and it can be present as aluminum metal or an aluminum compound, or compounds, especially as an aluminum oxide. The aluminum compound, or compounds thereof, is preferably contained in the catalyst in concentration ranging from about 0.01 percent to about 20 percent, preferably from about 0.5 percent to about 5 percent, calculated as aluminum oxide ($Al_2O_3$), based on the weight of the catalyst. Other metals may also be used as promoters and/or modifiers, which are added to or contained in the catalyst, such metals including rhenium, nickel, cobalt, palladium, platinum, and copper, or the compounds thereof. Such metals, or compounds thereof, may be added to the catalyst alone or admixed one metal with another, or with other metals, or the compound, or compounds thereof.

The iron based catalyst, as suggested, may also be supported; preferably upon an inorganic oxide support. Supports include, but are not limited to, the oxides of aluminum, silicon, boron, phosphorous, titanium, zirconium, calcium, magnesium, barium, and mixtures of these and other components. Other supports may include clays, such as bentonite, zeolites, and other alumino-silicate materials, e.g., montmorillionite. Additional supports may be selected from the group of refractory carbides and nitrides of the transition metals of Groups IVB, VB, VIB, VIIB, and Group VIII iron group metals. Alumina, magnesia, and admixtures thereof are preferred supports. The iron based catalysts are prepared by methods which include precipitation, coprecipitation, impregnation, vapor deposition, and the formation of metal complexes (i.e., metal carbonyl, etc.) and the like. The impregnation of a porous inorganic oxide support, such as alumina, with a solution of an iron salt with subsequent drying, calcination and reduction of the supported iron catalyst by contact and treatment of the catalyst with hydrogen or hydrogen and ammonia, or ammonia in admixture with another reducing gas, or gases, has been found to provide a highly active catalyst for color reduction and the removal of residual nitrogen from admixtures of hydrocarbons. Impregnation of the support with iron, or iron and other metal promoters or modifiers, by the incipient wetness technique, or technique wherein the iron is contained in solution in measured amount and the entire solution absorbed into the support, subsequently dried, calcined, and activated by contact with ammonia, or ammonia in admixture with hydrogen or other reducing gas has been found particularly satisfactory in preparing a supported catalyst. The supported iron catalyst is promoted or modified with alkali or alkaline-earth metals, or metal oxides such as sodium, potassium, cesium, magnesium, calcium, barium, or the like. The alkali or alkaline-earth metal, or metals, are generally employed in concentrations ranging from about 0.01 percent to about 10 percent, preferably from about 0.2 percent to about 4 percent, based on the total weight of metal, exclusive of the weight of the support. Sodium, potassium, magnesium, and calcium are the preferred alkali or alkaline-earth metals. Aluminum is also a preferred promoter, or modifier, of the catalyst, and it can be present as aluminum metal or an aluminum compound, or compounds, especially as an aluminum oxide. The aluminum metal, or compound thereof, is preferably employed in the catalyst in concentration ranging from about 0.01 percent to about 20 percent, preferably from about 0.5 percent to about 5 percent, calculated as aluminum oxide ($Al_2O_3$), based on the total weight of the supported component, exclusive of the weight of the support. Other metals may also be used as promoters and/or modifiers which are added to and contained within the catalyst, such metals including rhenium, nickel, cobalt, palladium, platinum, and copper can also be added to the catalyst, these metals generally being added in concentrations ranging from about 0.01 percent to about 10 percent, preferably in concentration ranging from about 0.5 percent to about 2.5 percent, based on the weight of the supported component, exclusive of the weight of the support. After impregnation of the support, the metal impregnated support is dried generally at temperatures ranging from about 65° C. (149° F.) to about 280° C. (536° F.), preferably from about 80° C. (176° F.) to about 110° C. (230° F.), in circulating air, vacuum or microwave oven. The calcination is suitably conducted at temperatures ranging from about 300° C. (572° F.) to about 650° C., (1202° F.) preferably from about 450° C. (842° F.) to about 550° C. (1022° F.).

The iron catalysts can be reduced, activated, or reactivated by contact with hydrogen, by sequential contact with hydrogen and ammonia, or reduced and activated by contact with an admixture of ammonia and hydrogen or by contact with an admixture of ammonia and another reducing gas or gases. The reducing gas and ammonia can be generated in situ or ex situ. The catalysts are more effectively activated if activated by contact with a stream of flowing hydrogen, or by contact with a stream characterized as an admixture of hydrogen and ammonia, or admixture of ammonia and another reducing gas, or gases. In addition, other pretreatment conditions may be used in combination with reduction in order to modify and/or enhance the catalyst. Treatment with a hydrocarbon rich blend with some carbon containing gas, e.g., carbon monoxide or carbon dioxide, can be used to introduce carbon to the catalyst.

The catalyst is reactivated, after deactivation, by contact with hydrogen, or by contact with ammonia in admixture with hydrogen, or ammonia in admixture with another reducing gas, or gases. Similarly, the activity-maintenance of the catalyst can sometimes be improved during an operating run by introducing ammonia, or ammonia in admixture with another gas, or gases, with the nitrogen-containing feed. In general, the ammonia is employed in admixture with another gas, or gases, in concentration ranging from about 0.01 percent to about 20 percent, preferably from about 0.2 percent to about 120 percent, based on the volume of the gas.

The catalyst is activated, pretreated, or reactivated by contact with the gas, or gaseous admixture, at temperatures ranging from about 300° C. (572° F.) to about 600° C. (1112° F.), preferably from about 400° C. (752° F.) to about 500° C. (932° F.). Suitably pressures range from about 0 psig to about 1500 psig, preferably from about 0 psig to about 750 psig. Hydrogen partial pressures generally range from about 0 psig to about 1200 psig, preferably from about 100 psig to about 600 psig. Space velocities generally range from about 100 GHSV to about 10,000 GHSV, preferably from about 1000 GHSV to about 5000 GHSV.

The invention will be more fully understood by reference to the following demonstations and examples which present comparative data obtained from runs illustrating its more salient features. All parts are given in terms of weight except as otherwise specified.

EXAMPLES

Commercially available Katalco 35-4 and United C73-1 fused iron ammonia synthesis catalysts were employed in conducting the demonstrations and examples described hereafter wherein low sulfur, low nitrogen feeds were treated to reduce the color, and propensity of the product to form color or sediment on standing in the presence of oxygen and light.

Table I contains some chemical composition and physical characteristic information on two commercial fused iron catalsyts used in the following examples. The Katalco 35-4 and United C73-1 catalysts on an as received basis are constituted of iron oxides modified by controlled amounts of alumina, calcia, potash, silica, and trace impurities. When reduced, the catalysts become highly active stable ammonia synthesis catalysts.

TABLE I

Chemical Composition and Physical Characteristics of Commercial Fused Iron Catalysts (as Received)

| | Katalco 35-4 | United C73-1 |
|---|---|---|
| I. Chemical Composition, Wt. % | | |
| FeO | 24.5 | 30–37 |
| $Fe_2O_3$ | 69.1 | 58–65 |
| Free Fe | Nil | $<-0.5$ |
| Total Fe Oxides | 93.6 | 94–96 |
| $Al_2O_3$ | 2.5 | 2.0–3.0 |
| $K_2O$ | 0.8 | 0.5–0.8 |
| CaO | 2.0 | 0.7–1.2 |
| $SiO_2$ | 0.4 | $<0.4$ |
| P | Trace | Trace |
| S as $SO_3$ | Trace | Trace |
| Chloride | $<10$ ppm | $<20$ ppm |
| $Fe^{3+}/Fe^{3+}$ | 0.41 | 0.45–0.65 |
| II. Physical Characteristics | | |
| Bulk Density | 165–170 lb/cu ft oxidized (120 lb/cu ft reduced) | |

In conducting these runs, a ½" I.D. stainless steel tubular reactor was employed, a modified prepared feed having been cocurrently introduced into the top of the reactor and passed downwardly over a fixed bed of fused iron catalyst ground and screened to 50–150 mesh size centered within the reactor. In introducing the feed, a dual piston, positive displacement pump was employed. The feed was pumped through a ⅛" diameter tubing to a tee, located just prior to entering the top of the reactor, where it was admixed with hydrogen before introduction to the reactor. An infrared furnace was employed to heat the reactor, and the temperature of the reaction was measured by a thermocouple located within the catalyst bed, and controlled by the use of an automatic temperature controller in operative association with the infrared furnace. The product was passed through a bottom adapter and collected in a vented, cooled flask located near the bottom of the reactor. A back pressure regulator was employed to maintain the desired pressure.

The following specific examples demonstrate the conversion of multi-ring aromatics and their partially or fully hydrogenated derivatives into lower molecular weight, lower boiling aromatic compounds. In Examples 1–3 model compounds, representing common types of multi-ring aromatics found in hydrocarbon oils, were converted at various conditions to lower boiling aromatic compounds, especially alkylbenzenes.

EXAMPLES 1–3

For Example 1, a 5.5 g/2.25. mL charge of UNITED C73-1 fused iron catalyst (50–150 mesh size) was charged to a reactor and reduced at 100 psig with a 5% $NH_3/H_2$ blend gas flowing at about 600 mL/min at 400° C. (752° F.) for 0.25 hour, 430° C. (806° F.) for 0.25 hour, and 470° C. (878° F.) for 2.0 hours. The reactor was then cooled to 270° C. (518° F.) and the treat gas was changed to hydrogen only. A model feed comprised of 2 wt. % 9,10-dihydroanthracene in 98 wt. % mesitylene (1,3,5-trimethylbenzene) was loaded into the feed pump buret. The run conditions employed were 270° C. (518° F.), flowing $H_2$ at 150 mL/min, a liquid feed rate of 7.5 mL/hour, and a pressure of 100 psig. The condensed liquid products taken from the receiving flask cooled in dry ice-methanol were then analyzed by gas-liquid chromatography (GC). About 94% of the 9,10-dihydroanthracene was converted to other products, about 14% of which were lower molecular weight alkylnaphthalenes and alkylbenzenes. The collective results are shown in Table II.

For Example 2, the same reactor and catalyst charge were used as employed in Example 1. After 22.8 hours of operation on the initial feed (Example 1), the pump buret was drained and a second model feed comprised of 1 wt. % anthracene in 99 wt. % mesitylene was loaded. After adequate flushing of the system to clear any remnants of the other feed and products, the temperature was increased to 285° C. (545° F.) while the other conditions were held constant. Products were once again collected and analyzed as above. In this case, 100% of the anthracene was converted to give about 56% lower boiling alkylnaphthalenes, alkyltetralins, and alkylbenzenes. The collective results are shown in Table II.

For Example 3 a separate 7.70 g/3.0 mL charge of UNITED C73-1 fused iron catalyst (50–150 mesh size) was loaded into a reactor and reduced in flowing hydrogen (300 mL/min) for 16 hours at 470° C. (878° F.). A model feed containing 2 wt. % phenanthrene in 98 wt. % mesitylene was loaded into the pump buret and the pump rate was set at about 5.5 mL/hour. The reaction pressure was varied from 0 to 50 psig, the $H_2$ gas rate was held constant at 150 mL/min, and the temperature was varied between 300° C. (572° F.) and 350° C. (662° F.). Products were collected and analyzed as described above. Conversion and product slate were directly dependent upon both the $H_2$ pressure and the temperature as indicated by the results shown in Table II.

TABLE II

Conversion of Model Multi-ring Aromatic Compounds to Lower Molecular Weight Aromatics

| Model Compound | Example 1 9,10-dihydro-anthracene | Example 2 Anthracene | Example 3 Phenanthrene | | |
|---|---|---|---|---|---|
| Temp.(°C.) | 270 | 285 | 300 | 350 | 350 |
| Pres.(psig) | 100 | 100 | 0 | 0 | 50 |
| % Total Conversion | 94 | 100 | 28 | 83 | 100 |
| % Hydrogenation Only Products | 86 | 44 | 9 | 5 | 1 |
| % Alkylnaphthalenes or tetralins | 8 | 44 | 13 | 16 | 15 |
| % Alkylbenzenes and benzene | 6 | 12 | 6 | 62 | 84 |

Examples 4 and 5, which follow, illustrate the practice of this invention to improve the color quality and oxidative stability of hydrocracked stocks by reducing the level of multi-ring aromatics/PNAs and their partially or fully hydrogenated derivatives. The feedstocks employed in these examples were essentailly free of nitrogen and sulfur (less than 5 wppm each), this reinforcing the belief that multi-ring aromatics/PNA removal is the mechanism for color and oxidation stability improvement that is obtained.

EXAMPLE 4

For Example 4, a 400°–850° F. (204°–454° C.) hydrocracker product stream, unacceptably dark in color and having poor oxidative stability, was obtained from a pilot plant stream. The unstable material was treated over the fused iron catalyst in order to improve both color and stability. Thus, a 2.25 mL/5.6 g charge of UNITED C73-1 fused iron catalyst (50–150 mesh size) was loaded into the ½ inche S.S. reactor, supra. This catalyst was then activated at atmospheric pressure in flowing 5% $NH_3/H_2$ (600 mL/min) at 400° C. (752° F.) for 0.25 hour, 430° C. (797° F.) for 0.25 hour, and 470° C. (878° F.) for 2.0 hours. The reactor was then cooled to 270° C. (518° F.) and the treat gas was changed to hydrogen only. The unstable, colored hydrocracker product stream was then passed over this bed of activated fused iron catalyst, with the results given in Table III. Following treatment of the hydrocracker product stream with the fused iron catalyst, as shown there is a sharp improvement in product color, color stability, and there appears no evidence of, or tendency for sediment formation.

TABLE III

Color and Oxidation Stability Improvement of Hydrocracker Product Sample Following Treatment Over Fused Iron Catalyst

| | Sample Before Treatment | After Fused Iron Treatment Condition 1 | After Fused Iron Treatment Condition 2 |
|---|---|---|---|
| RUN CONDITIONS: | | | |
| Temp, °F. (°C.) | — | 518 (270) | 545 (285) |
| Total psig | — | 0 | 0 |
| LHSV | — | 4.6 | 2.7 |
| TGR, SCF/B | — | 5000 | 8200 |
| Qualitative Color Assessment | poor | excellent | excellent |
| Qualitative Color and Appearance Description | | | |
| Initial Sample | murky, reddish-orange | clear with a pale yellow color | |

TABLE III-continued

Color and Oxidation Stability Improvement of Hydrocracker Product Sample Following Treatment Over Fused Iron Catalyst

| | Sample Before Treatment | After Fused Iron Treatment | |
|---|---|---|---|
| | | Condition 1 | Condition 2 |
| After 9 Months (in light/air) | dark reddish-brown with brown film | light gold, clear | light yellow, clear |
| Sediment Formation | yes | no | no |

EXAMPLE 5

In Example 5, a high pressure hydrocracker recycle stream from a commercial hydrocracker was used as the feedstock. This feedstock had a boiling range of about 400°-900° F. (204°-482° C.), was dark gold in color, contained a significant portion of solid waxy material at room temperature, and was relatively unstable toward sediment formation. The higher boiling portion of this feed, after dewaxing operations, has potential for application in lubes formulations. However, this material's instablility toward sediment formation upon exposure to light and oxygen (air) causes poor performance in a simple "daylight stability" test (exposure of the sample to sunlight and air at a slightly elevated temperature) which is used to monitor the apparent oxidation stability of lubestocks. To demonstrate this invention, this hydrocracker recycle stream was treated over an activated Katalco 35-4 fused iron catalyst in order to improve oxidation stability and minimize, suppress or prevent, sedimentation from occurring.

For this run, a 16.0 mL/45.5 g charge of the KATALCO 35-4 fused iron catalyst (50-150 mesh size) was loaded into the ½ inch S.S. reactor. This catalyst charge was then pretreated and reduced under the following regimen of conditions:

| Temperature range | Treat gas at 300 mL/min | Time at Conditions |
|---|---|---|
| 25-400° C. (77-752° F.) | $H_2$ only | about 1.5 hours |
| 400-430° C. (752-806° F.) | 5% $NH_3$ in $H_2$ | about 1.0 hour |
| 430-470° C. (806-878° F.) | 5% $NH_3$ in $H_2$ | about 2.0 hours |
| 470-400° C. (878-806° F.) | 5% $NH_3$ in $H_2$ | about 1.0 hour |
| 400-300° C. (806-572° F.) | $H_2$ only | about 1.0 hour |

The unstable hydrocraker recycle stream was then fed to the catalyst bed and treated over the activated fused iron catalyst at the conditions noted in Table IV below. The results shown in Table IV clearly indicate an improvement in color, color stability, sedimentation stability, and product appearance following treatment over the fused iron catalyst. The fused iron treated products, especially the colorless material with no visible wax at room temperature, appear far more useful as lubestock feeds than the original hydrocracker recycle stream.

TABLE IV

Color and Oxidation Stability Improvement of Hydrocracker Recycle Stream Following Treatment Over Fused Iron Catalyst

| | Feed | Sample 5A | Sample 5B | Sample 5C | Sample 5D |
|---|---|---|---|---|---|
| Run Time (Hrs.) | — | 29-125 | 125-176 | 176-226 | 226-273 |
| Pres. (psig) | — | 100 | 250 | 100 | 100 |
| Temp. (°C./°F.) | — | 315/599 | 330/626 | 330/626 | 330/626 |
| LHSV | — | 1.0 | 1.0 | 1.0 | 0.6 |
| TGR (SCF/B $H_2$) | — | 4000 | 4000 | 4000 | 8-12,000 |
| Color and Appearance (at 25° C.) | dark gold, heavy wax | light yellow, lt. wax | dark yellow, lt. wax | light straw, lt. wax | colorless, no wax |
| Days to haze | 1 | 3 | 2 | 4 | 6 |
| Days to sludge (in light & air) | 2 | 6 | 3 | 6 | 7 |

It is apparent that various modifications and changes can be made without departing the spirit and scope of the invention.

Having described the invention, what is claimed is:

1. A process for improving the color and oxidation stability of a feed characterized as an admixture of hydrocarbons, inclusive of hydrocarbons selected from the group consisting of fused multi-ring aromatic hydrocarbons, and fused multi-ring hydroaromatic hydrocarbons, said feed containing organic sulfur and organic nitrogen in concentrations greater than 10 wppm organic sulfur, greater than 10 wppm organic nitrogen, or greater than 10 wppm organic sulfur and greater than 10 wppm organic nitrogen, and having a high end point boiling below about 538° C. and a low end boiling point above about 224° C., which comprises in combination, contacting said feed, and hydrogen, over a hydrotreating catalyst and hydrotreating said feed at hydrotreating conditions, separating sulfur as hydrogen sulfide, or nitrogen as ammonia, or separating both sulfur as hydrogen sulfide and nitrogen as ammonia, from the hydrotreated reaction product, and distilling said hydrotreated product to obtain a high boiling fraction, and contacting said high boiling hydrotreated product fraction from which sulfur, and nitrogen have been removed to less than 10 wppm organic sulfur and less than 10 wppm organic nitrogen, as a feed, in the presence of hydrogen, over a catalyst comprised of elemental iron and one or more alkali or alkaline-earth metals components at a temperature ranging from about 225° C. to about 430° C. and hydrogen partial pressure ranging from about 0 psig to about 1000 psig at temperature sufficient to improve product color, or stabilize the product of said reactor against light and oxygen degradation, or both.

2. The process of claim 1 wherein the hydrotreating catalyst with which the feed and hydrogen are contacted at hydrotreating conditions is characterized as a composite of a porous refractory inorganic oxide and a Group VI-B or Group VIII metal, or both.

3. The process of claim 2 wherein the Group VI-B metal of the catalyst is molybdenum or tungsten, and the Group VIII metal is cobalt or nickel.

4. The process of claim 3 wherein the metals of the catalyst are cobalt and molybdenum, or nickel and molybdenum.

5. The process of claim 2 wherein the porous refractory inorganic oxide portion of the catalyst composite is alumina.

6. The process of claim 1 wherein the iron catalyst with which the high boiling hydrotreated product fraction as a feed, and hydrogen are contacted, is a bulk iron catalyst which contains at least 50 percent elemental iron.

7. The process of claim 6 wherein the catalyst is a fused iron catalyst.

8. The process of claim 1 wherein the iron catalyst with which the high boiling hydrotreated product fraction as a feed, and hydrogen are contacted, is a bulk iron catalyst which contains from about 70 percent to about 98 percent elemental iron.

9. The process of claim 1 wherein the iron catalyst with which the high boiling hydrotreated product fraction as a feed, and hydrogen are contacted, contains the alkali or alkaline-earth metals, or both, in concentrations ranging from about 0.01 percent to about 10 percent.

10. The process of claim 9 wherein the iron catalyst additionally contains aluminum in concentration ranging from about 0.01 percent to about 20 percent.

11. The process of claim 1 wherein the iron catalyst with which the feed and hydrogen are contacted is a supported iron catalyst, the catalyst containing at least about 0.1 percent iron, based on the total weight of the catalyst, the supported metallic component containing at least 50 percent elemental iron, exclusive of the support component, or components.

12. The process of claim 11 wherein the iron catalyst contains from about 70 percent to about 98 percent iron, exclusive of the support component, or components.

13. The process of claim 11 wherein the supported iron catalyst, with which the feed and hydrogen are contacted, is modified with one or more alkali or alkaline-earth metals in concentration ranging from about 0.01 percent to about 10 percent, and aluminum in concentration ranging from about 0.01 percent to about 20 percent.

14. The process of claim 1 wherein the hydrotreated product is introduced as a feed into a hydrocracking reactor and hydrocracked at hydrocracking conditions to convert the feed into gasoline, distillate fuels, and a heavy product suitable as lube stock, the product is distilled into fractions inclusive of a heavy bottoms fraction containing less than about 5 wppm organic sulfur and less than about 5 wppm organic nitrogen, and the heavy bottoms fraction is reacted with hydrogen over said iron catalyst.

15. A process for improving the color and oxidation stability of a feed characterized as an admixture of hydrocarbons, inclusive of hydrocarbons selected from the group consisting of fused multi-ring aromatic hydrocarbons, and fused multi-ring hydroaromatic hydrocarbons, said feed containing organic suflur and organic nitrogen in concentrations greater than 10 wppm organic sulfur, greater than 10 wppm organic nitrogen, or greater than 10 wppm organic sulfur and greater than 10 wppm organic nitrogen, and having a high end point boiling below about 538° C. and a low end boiling point above about 224° C., which comprises in combination, contacting said feed, and hydrogen, over a hydrotreating catalyst and hydrotreating said feed at hydrotreating conditions, recovering said hydrotreated liquid product and contacting said liquid product, with hydrogen, over a hydrocracking catalyst at hydrocracking conditions, separating sulfur as hydrogen sulfide, or nitrogen as ammonia, or separating both sulfur as hydrogen sulfide and nitrogen as ammonia, from the hydrocracked reaction product, distilling said hydrocracked product to obtain a high boiling fraction, and then contacting said high boiling product fraction from which sulfur and nitrogen have been removed to less than 10 wppm organic sulfur and less than 10 wppm organic nitrogen, as a feed, in the presence of hydrogen, over a catalyst comprised of elemental iron and one or more alkali or alkaline-earth metals components at a temperature ranging from about 225° C. to about 430° C. and hydrogen partial pressure ranging from about 0 psig to about 1000 psig at temperature sufficient to stabilize said product against light and oxygen degradation.

16. The process of claim 15 wherein the hydrotreating catalyst with which the feed and hydrogen are contacted at hydrotreating conditions is characterized as a composite of a porous refractory inorganic oxide and a Group VI-B or Group VIII metal, or both, the hydrocracking catalyst with which the hydrotreated product is contacted and reacted at hydrocracking conditions is characterized as a composite of a porous refractory inorganic oxide, a Group VI-B or Group VIII metal, or both, and an acidic cracking component which supplies the cracking function, and the iron catalyst with which the hydrocracked product fraction as a feed, and hydrogen, are contacted, contains said alkali or alkaline-earth metals in concentrations ranging from about 0.01 percent to about 10 percent.

17. The process of claim 16 wherein the iron catalyst additionally contains aluminum in concentration ranging from about 0.01 percent to about 20 percent.

18. The process of claim 16 wherein the iron catalyst with which the hydrocracked product fraction as a feed, and hydrogen, are contacted, is a bulk iron catalyst which contains at least 50 percent elemental iron.

19. The process of claim 18 wherein the catalyst is a fused iron catalyst.

20. The process of claim 18 wherein the iron catalyst is a bulk iron catalyst which contains from about 70 percent to about 98 percent elemental iron.

21. The process of claim 16 wherein the iron catalyst with which the hydrocracked product fraction and hydrogen are contacted is a supported iron catalyst, the catalyst containing at least about 0.1 percent iron, based on the total weight of the catalyst, the supported metallic component containing at least 50 percent elemental iron, exclusive of the support component, or components.

22. The process of claim 21 wherein the iron catalyst contains from about 70 percent to about 98 percent iron, exclusive of the support component, or components.

* * * * *